US009186037B2

(12) United States Patent
Jerg et al.

(10) Patent No.: US 9,186,037 B2
(45) **Date of Patent: *Nov. 17, 2015**

(54) DISHWASHER COMPRISING A SORPTION DRYING DEVICE, AND METHOD FOR THE OPERATION THEREOF

(75) Inventors: Helmut Jerg, Giengen (DE); Kai Paintner, Welden (DE)

(73) Assignee: BSH Hausgeraete GmbH, Munich (DE)

( * ) Notice: Subject to any disclaimer, the term of this patent is extended or adjusted under 35 U.S.C. 154(b) by 165 days.

This patent is subject to a terminal disclaimer.

(21) Appl. No.: 13/483,083

(22) Filed: May 30, 2012

(65) Prior Publication Data

US 2012/0234354 A1 Sep. 20, 2012

Related U.S. Application Data

(63) Continuation of application No. 11/792,691, filed as application No. PCT/EP2005/056533 on Dec. 6, 2005, now abandoned.

(30) Foreign Application Priority Data

Dec. 9, 2004 (DE) ..... 10 2004 059 422
Jan. 28, 2005 (DE) ..... 10 2005 004 092

(51) Int. Cl.
*A47L 15/48* (2006.01)

(52) U.S. Cl.
CPC ..... *A47L 15/481* (2013.01)

(58) Field of Classification Search
CPC ..... A47L 15/481
USPC ..... 134/56 D, 57 D, 58 D
See application file for complete search history.

(56) References Cited

U.S. PATENT DOCUMENTS

| | | | | |
|---|---|---|---|---|
| 3,034,221 | A * | 5/1962 | Tuck et al. | 34/527 |
| 4,534,955 | A | 8/1985 | Rosenbaum | |
| 6,161,306 | A | 12/2000 | Clodic | |
| 6,283,709 | B1 | 9/2001 | Hill et al. | |
| 8,734,592 | B2 * | 5/2014 | Jerg et al. | 134/25.2 |
| 2003/0079760 | A1 | 5/2003 | Spanyer et al. | |
| 2003/0221709 | A1 | 12/2003 | Jung et al. | |

(Continued)

FOREIGN PATENT DOCUMENTS

| | | | |
|---|---|---|---|
| DE | 2016831 | A1 | 10/1971 |
| DE | 3626887 | A1 | 2/1988 |

(Continued)

OTHER PUBLICATIONS

Machine Translation of Saito et al.., JP 2001087203 A, Apr. 2001.*

(Continued)

*Primary Examiner* — David Cormier
(74) *Attorney, Agent, or Firm* — James E. Howard; Andre Pallapies

(57) ABSTRACT

A dishwasher comprising at least one partial program step "drying" in which air from a washing container of the dishwasher and/or ambient air is directed through a sorption column with reversibly dehydratable material into the washing container by a fan, and humidity is removed from the air when the same is directed therethrough. The fan is operated at different rotational speeds in accordance with a main controller of the dishwasher in order to influence the adsorption process.

34 Claims, 2 Drawing Sheets

(56) References Cited

U.S. PATENT DOCUMENTS

| | | | |
|---|---|---|---|
| 2006/0278257 | A1 | 12/2006 | Jerg et al. |
| 2007/0101609 | A1 | 5/2007 | Jerg et al. |

FOREIGN PATENT DOCUMENTS

| | | | | |
|---|---|---|---|---|
| DE | 3741652 | A1 | | 6/1989 |
| DE | 10058188 | A1 | | 5/2002 |
| EP | 0358279 | A1 | | 3/1990 |
| EP | 1127532 | A2 | | 8/2001 |
| EP | 1415588 | A2 | | 5/2004 |
| JP | 8224201 | A | | 9/1996 |
| JP | 10328120 | A | | 12/1998 |
| JP | 11042197 | A | | 2/1999 |
| JP | 2000126540 | A | | 5/2000 |
| JP | 2001087203 | A | * | 4/2001 |
| JP | 2002253469 | A | | 9/2002 |

OTHER PUBLICATIONS

Machine Translation of Fried et al., EP 0358279, Mar. 1990.*
Machine Translation of Meynberg, DE 3626887, Feb. 1988.*
International Search Report PCT/EP2005/056533.
National Search Report DE 10 2005 004 092.6.

* cited by examiner

DISHWASHER COMPRISING A SORPTION DRYING DEVICE, AND METHOD FOR THE OPERATION THEREOF

CROSS-REFERENCE TO RELATED APPLICATION

This application is a continuation, under 35 U.S.C. §120, of U.S. application Ser. No. 11/792,691, filed Jun. 7, 2007, which is a U.S. national stage application under 35 U.S.C. §371 of PCT/EP2005/056533, filed Dec. 6, 2005, which designated the United States; this application also claims the priority, under 35 U.S.C. §119, to German Application No. 10 2004 059 422.8, filed Dec. 9, 2004, and to German Application No. 10 2005 004 092.6, filed Jan. 28, 2005.

BACKGROUND OF THE INVENTION

The invention relates to a dishwasher with a sorption drying device. The invention further relates to a method for operating a dishwasher with at least one partial step "drying", in which air from a washing container of the dishwasher and/or ambient air is in this partial program step directed through a sorption column with reversibly dehydratable material into the washing container by a fan, and humidity is removed from the air when the same is directed therethrough.

Conventional dishwashers have, as is well known, a washing process whose programmed sequence consists of at least one partial program step "pre-wash", a partial program step "cleaning", at least one partial program step "clear washing and a partial program step "drying". To increase the cleaning effect, the washing bleach is in this case heated before or during a partial program step. The washing bleach is normally heated by electrical heating devices. Different drying systems are known for drying the items to be washed in a dishwasher.

For example, DE 20 16 831 discloses a dishwasher of the type already mentioned, in which the air is directed from the washing container through a sealable opening in the wall of the washing container on reversibly dehydratable material, and from there out trough an opening. The desorption of the reversibly dehydratable material takes place during the stationary phase of the appliance, the water vapour formed thereby being directed out through the opening. The dishwasher described is disadvantageous from the energy viewpoint because the regeneration of the reversibly dehydratable material takes place during a stationary phase of the appliance and therefore at a time when none of the partial program steps described above is being carried out. A further disadvantage consists in the fact that damage to the surrounding kitchen furniture by the discharge of the water vapour formed during the regeneration of the reversibly dehydratable material to the outside cannot be ruled out. Here the regeneration is associated with an additional energy requirement which is added to the energy required during the partial program steps.

In order to minimise the energy expenditure when a dishwasher is operated, a dishwasher with a washing container and devices for washing cutlery and dishes by means of a washing bleach is known from DE 103 53 774.0 of the applicant, which dishwasher has a sorption column connected in an air conducting manner to the washing container and containing reversibly dehydratable material, where on the one hand the sorption column is for drying the cutlery and dishes and on the other hand the thermal energy introduced for desorption of the sorption column is used to heat at least partially the washing bleach and/or the cutlery and dishes in the washing container.

To solve the same problem DE 103 53 775.9 of the applicant proposes guiding air from a washing container and/or from ambient air through a sorption column and into the washing container for operating an appliance in the at least one partial program step "drying", the sorption column containing reversibly dehydratable material and removing humidity from the air when it is directed through it.

Because of the use of reversibly dehydratable material with a hygroscopic property, e.g. zeolith, heating of the items to be treated is no longer normally necessary in the partial program step preceding the partial program step "drying". This allows a considerable saving in energy.

EP 0 358 279 B1 discloses a device for drying cutlery and dishes in a domestic dishwasher in which the washing bleach is heated by a heater arranged outside the washing container, preferably an electric geyser, a largely closed drying system being provided in which air circulates from the washing container via a drying device that can be regenerated by heating and from this back into the washing container. In this case the drying device consists of a drying container in thermal contact with the heater, which container is filled with a drying agent adsorbing the humidity. The connection of the drying container to the heater that is provided in any case for heating the washing bleach means that the drying device is operational immediately after the washing process. Here the drying agent is applied at least partially as a jacket around the heating elements of the heater so that the drying agent can be heated in the drying container during each heating process and can therefore be dried.

The drying container is designed as a double-walled hollow cylinder in which the drying material is stored. The inlet and outlet opening for connection to the closed air system is arranged in a diagonally opposing configuration. The disadvantage of this is a relatively high flow resistance, with the result that the fan provided for promoting the air flow must be operated at very high power. This has a negative effect on noise development and energy consumption.

Because of the structural design of the sorption drying device, which requires inhomogeneous introduction of heat into the drying material, the desorption is time consuming and may also result in local overheating of the drying agent and hence irreversible damage. Desorption is also difficult because the heater is arranged in the centre of the double-walled hollow cylinder and radial propagation of the heat to the drying agent located close to the outer hollow cylinder wall is hardly possible due to the air flowing axially past it.

BRIEF SUMMARY OF THE INVENTION

The object of this invention is therefore to provide a method for operating a dishwasher and a dishwasher with which it is possible to shorten the duration of a washing program with a plurality of partial program steps.

This object is achieved by the method according to the invention with the features according to Claim 1 and by a dishwasher with the features of Claim 6. Advantageous further developments of this invention are described in the relevant dependent claims.

In the method according to the invention for operating a dishwasher with at least one partial program step "drying" where, in this partial program step, air is directed by a fan from the washing container of the dishwasher and/or ambient air through a sorption column with reversibly dehydratable material in the washing container and humidity is removed from the air as it is directed therethrough, the fan is operated at different speeds determined by a main control system in the dishwasher. This provides the possibility of considerably reducing the duration of a partial program step "drying".

In an advantageous design the air is directed through by a fan that can be steplessly operated at a variable speed, the speed of the fan being established according to the desired duration of the partial program step. According to this advantageous design a dishwasher can be operated during the partial program step with the washing bleach to be heated at a constant, low and hence noise-optimised speed. On the other hand it is possible to increase the speed of a controlled fan so that the adsorption process is accelerated, thereby enabling the drying time to be shortened.

Such a time-reduced washing program is in this case associated with increased operating noise. It is therefore advantageous for the speed of the fan to be selected in a plurality of states by means of a control element of the dishwasher. In other words a function may be provided in the control element of the dishwasher, which function enables a user actively to select a "fast washing program", in which case the user then consciously decides on increased noise development associated with this.

According to a suitable variant of this method according to the invention the air is heated by condensation heat as it is directed through the sorption column, and is additionally heated, if necessary, by an electrical heating element. This ensures that air at high temperature is introduced into the washing space of the dishwasher, thereby increasing its moisture absorptivity, enabling the duration of the partial program step "drying" to be reduced.

According to a further suitable design the washing items to be treated are heated with the washing bleach to be heated in a partial program step that takes place before the partial program step "drying", e.g. clear washing. Therefore the washing items to be dried have their own heat which is already higher at the beginning of the partial program step "drying", so that the discharge of the humidity present on the washing items to the dry air is further improved. This also enables a reduction in this partial program step to be achieved.

A dishwasher according to the invention has the same advantages as were explained in connection with the above-mentioned method.

In the case of a dishwasher designed according to the invention, in particular a domestic dishwasher, with a washing container and devices for washing items to be washed by means of a washing bleach, where the latter has a sorption column connected in an air conducting manner to the washing container and containing reversibly dehydratable material, where on the one hand the sorption column is used on the one hand for drying the cutlery and dishes and on the other hand the thermal energy introduced for desorption of the sorption column is used to heat the washing bleach and/or the items to be washed in the washing container, a fan of the sorption drying device is designed so that its speed can be controlled by a main control unit of the dishwasher.

One advantage consists in that a very simple structural design is provided for such a dishwasher. In principle the dishwasher may be designed as described in DE 103 53 774.0 of the applicant, the content of which is incorporated by reference in this application where appropriate. The machine described here differs from the control and operation of the sorption drying device, particularly in respect to the fan, which is designed so that its speed can be regulated for controlling the drying time.

According to a preferred feature, air is directed from the washing container and/or from the ambient air through the sorption column and into the washing container during a partial program step with the washing bleach to be heated, preferably during the partial program step "drying." In some embodiments, air from the washing container and/or from the ambient air may also be directed through the sorption column and into the washing container during a partial program step "cleaning" and/or "pre-wash."

According to a further preferred feature the washing container has an outlet with a pipe to the sorption column, the pipe preferably having a shutoff valve and preferably an inlet valve to the ambient air that connects in the direction of flow, and the washing container having an inlet with a pipe from the sorption column, where the fan which introduces at least partially a proportion of the air in the washing container or from the ambient air of the sorption column is arranged in the pipe to the sorption column. In a preferably closed air system an exchange of contaminated air from the surround area is totally excluded, thereby preventing the treated items to be washed from becoming dirty again. The fan can easily be actuated so that the use of the sorption column and hence the drying process can be actually controlled.

A preferably electric heating element is suitably arranged for desorption of the reversibly dehydratable material and heating the air directed into the washing space. This element is preferably arranged in the reversibly dehydratable material or in the pipe to the sorption column.

It is also appropriate for the fan of the sorption drying device to be stepless or to be selectable in plurality of stages by a control element of the dishwasher.

BRIEF DESCRIPTION OF THE DRAWINGS

The invention is explained in greater detail in the following with reference to the exemplary example of a method in a dishwasher represented in FIGS. 1 and 2.

DETAILED DESCRIPTION OF EXEMPLARY EMBODIMENTS OF THE PRESENT INVENTION

Figure 1:
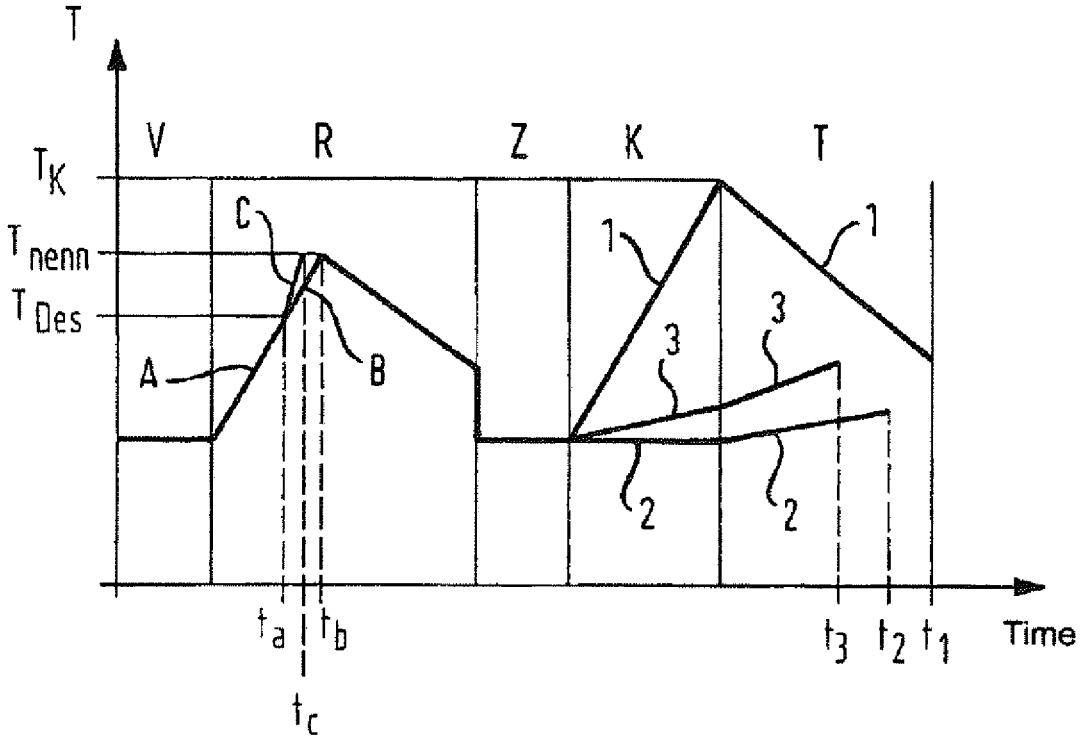
Figure 2:
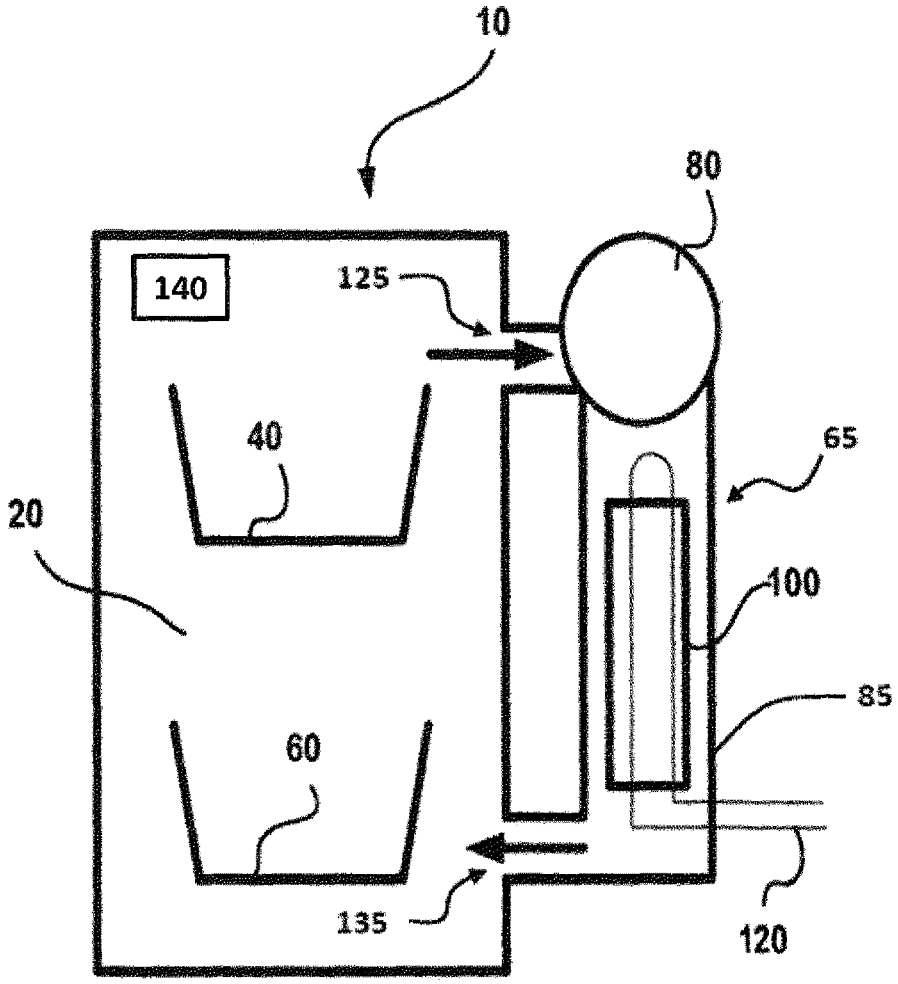

The method according to the invention for operating a dishwasher with at least one partial program step, with a washing bleach to be heated to a nominal temperature and/or with at least one partial program step "drying" is carried out in the exemplary embodiment explained in a dishwasher which is constructed diagrammatically, as described in DE 103 53 774 and/or 103 53 775 of the applicant. As is known a dishwasher has a washing process whose program sequence generally consists of a partial program step "prewash" V, partial program step "cleaning" R, at least one partial program step "intermediate washing" Z, a partial program step "clear washing" K; and a partial program step "drying" T. The drying preferably carried out in the exemplary embodiment is described in DE 103 53 774 and/or DE 103 53 775, the contents of which are incorporated by reference in this application. Here the figure represents the typical temperature curve of the washing bleach during these partial program steps, the figure showing both the operation in a conventional dishwasher and operation according to the method according to the invention.

The partial program steps "prewash" V and "intermediate washing" Z are of subordinate importance for the methods according to the invention, thus they are not considered in greater detail in the following description. At the beginning of the partial program step "Cleaning" R the washing bleach is normally heated to a nominal temperature $T_{nenn}$ in order to achieve the desired cleaning effect. In an energy-optimised dishwasher with a sorption drying device, as is already known in the state of the art, the desorption, i.e. the heating of the reversibly dehydratable material, also takes place during the partial program step "Cleaning" R. The content of DE 103 53 774 and/or DE 103 53 775 is incorporated by reference in this application.

Conventional heating, e.g. a geyser, may be used for heating the washing bleach. However, it is also conceivable to dispense with such "water heating" and only use the energy required for the desorption.

The dishwashing machine 10 may include a rinsing container (e.g., washing container) 20 for washing crockery using a washing solution, baskets (e.g., 40, 60), and a main control system 140. For this purpose an (air) heating system (e.g., heating device) 120 is operated which is arranged in the sorption drying device 65 and which heats the reversibly dehydratable material 100, e.g. zeolith, to a high temperature. During the desorption of the reversibly dehydratable material 100 air is directed from a washing container 20, e.g. with an outlet 125, through a sorption column 85 and then back into the washing container 20 via an inlet 135, the air being heated during its passage through the heating system 120. In this case the air is sucked out of the washing container 20 and forced through the sorption column 85 by means of a fan 80. The hot water vapour escaping from the sorption column 85 and the air now heated enter the washing container 20 through the above-mentioned inlet 135 and there meet the circulated treatment or washing bleach and/or the cutlery and dishes that are heated thereby.

Normally the sorption drying device is operated only until the reversibly dehydratable material is fully desorbed, i.e. dehumidified (Section A in the figure). In the exemplary embodiment shown in the figure this could be reached at a time $t_a$, at which the washing bleach and/or the items to be washed have reached a temperature $T_{Ds}$. This temperature is normally below the nominal temperature $T_{nenn}$ to be achieved. In order to bridge this temperature difference the electric heating element and the fan of the sorption drying device are further operated and hot air is fed into the washing container until the circulated washing bleach and/or the items to be treated reach the desired nominal temperature (Section B). This condition is achieved with suitable dimensioning of the sorption drying device, particularly the power of the heating system, the speed of the fan and the arrangement and geometry of the sorption column at a time $t_b$.

In order to be able to carry out the partial program step "cleaning" R faster, i.e. in order to be able to reach the desired nominal temperature $T_{nenn}$ faster, an additional heating system may be provided according to another variant, which system is operated during Section A and/or during section B to increase the temperature from $T_{Des}$ to $T_{nenn}$, so that the nominal temperature $T_{nenn}$ is already reached at a time $t_c$ (Section C). The additional heating system may be designed either as a water heating system, e.g. as a geyser, or as an air heating system incorporated in the air circuit. In both cases the additional heating system may be dimensioned so that only a lower heating power, capable of making up the temperature difference between $T_{Des}$ and $T_{nenn}$, need be made available. It is not clear from the figure, but easily understood by a person skilled in the art, that the washing bleach heating phase is terminated regardless of the time at which the nominal temperature $T_{nenn}$ is reached (in the exemplary embodiment $t_b$ or $t_c$, resulting in a drop in the treatment temperature by the end of the partial program step "cleaning" R. The extent to which the treatment temperature falls, and the duration of the fall, depend on the nature of the cleaning program carried out and on the insulating properties of the dishwasher.

According to a further variant provision may also be made for the speed of the fan of the sorption drying device to increase during the partial program step "cleaning" R to achieve a further reduction in the time until the nominal temperature $t_{nenn}$ is reached. This could be achieved so that it may be pre-selected by a user of the dishwasher, e.g. by means of a control element.

In conventional dishwashers the items to be washed are dried by so-called intrinsic heat drying in the partial program steps "clear washing" and "drying" (Section 1). Here the washing bleach is heated in the partial program step "clear washing", as a result of which the hot clear washed is dries spontaneously as a result of the intrinsic heat of the items to be washed thus developed during the drying process. To achieve this intrinsic heat drying the washing bleach is therefore heated to the temperature $T_K$ in the partial program step "clear washing" and is applied to the items to be washed by spraying devices. Due to the relatively high temperature of the washing bleach in the partial program step "clear washing", normally from 65° C. to 75° C., a sufficient quantity of heat is transferred to the items to be washed to enable the water adhering to the items to be washed to be evaporated by the heat stored in the items to be washed.

A considerable energy saving is achieved by sorption drying devices because in these devices the washing bleach need not in principle be heated in the partial program step "clear washing" K (Section 2), but it can be heated only to a small extent (Section 3). The drying is carried out in that air is directed from the washing container and/or from ambient air through the sorption column into the washing container in the partial program step "drying", the sorption column containing reversibly dehydratable material removing humidity from the air as it is directed through the column Because reversibly dehydratable material with a hygroscopic property, e.g. zeolith, is used, the items to be treated need not normally be heated in the partial program step preceding the partial program step "drying" (Section 2), but heating may continue to take place to low temperatures, e.g. up to 30° C. during "clear washing" (Section 3). Because the air is heated by means of the sorption column, in which the condensation heat of the water vapour is released, its moisture receiving capacity is increased whenever it passes through the sorption column, leading to an improvement in the drying result and a shortening of the drying time. Additional heating of the air with a supplementary heating system in the partial program step "drying", supplementary to heating with the sorption column and, and therefore also of the cutlery and dishes in dishwashers, for example, is not normally necessary because the thermal energy released in the sorption column is sufficient to heat the air to high temperatures, e.g. 70° C. The sorption column itself is heated by the condensation heat to temperatures of up to 160° C., for example.

An acceleration of the drying process, which in conventional dishwashers is carried out by a time program control system and lasts until time $t_1$, can be achieved by providing in the sorption device a fan whose speed is controlled steplessly or in a plurality of steps. The adsorption process is accelerated by increasing the speed, which results in a shortening of the drying time.

If an increase in the temperature during the partial program step "clear washing" is dispensed with, the drying can already be completed at item $t_2$ (Section 2). A further shortening of the drying time can be achieved by increasing the clear washing temperature (Section 3), as explained above, enabling the drying to be completed at time $t_3$. Here it must be assumed that the drying efficiency or degree of drying of the washing items to be dried is identical in all three variants.

Since the increase in the speed of the fan of the sorption drying device is associated with increased noise emission, it is advantageous for this mode of operation to be carried out actively by a user of the dishwasher. This could be achieved, for example, by providing a suitable control element which is connected to a main control system of the dishwasher and allows a suitable mode of operation.

The present invention provides a method with which it is possible to operate a dishwasher of the type already mentioned economically and to minimise the associated energy expenditure in a time-optimised manner.

What is claimed is:

1. A dishwasher, comprising:

a washing container;

a main control system programmed to conduct a plurality of partial program steps including at least a drying partial program step and a cleaning partial program step;

a sorption drying device connected to the washing container in an air-conducting manner and to dry crockery therein, the sorption drying device comprising a variable speed fan and a sorption column that includes a reversibly dehydratable material; and wherein in the drying partial program step the variable speed fan is configured to conduct at least one of air from the washing container and ambient air through the sorption column with reversibly dehydratable material into the washing container, thereby removing moisture from the air during passage therethrough, and wherein in the cleaning partial program step, the variable speed fan is configured to conduct at least one of air from the washing container and ambient air through the sorption column with reversibly dehydratable material into the washing container thereby desorbing the reversibly dehydratable material and warming at least one of the washing container, washing solution, and crockery therein, and wherein the main control system is configured to control and provide different rotational speeds for the variable speed fan, wherein the main control system operates the variable speed fan at a first rotational speed during the drying partial program step, and at a different second rotational speed during the cleaning partial program step.

2. The dishwasher of claim 1, wherein thermal energy for desorption of the sorption column is utilized to heat up at least one of the washing solution and the crockery in the washing container.

3. The dishwasher of claim 1, wherein at least one of air from the washing container and ambient air is directed through the sorption column and into the washing container during a partial program step of the dishwasher that heats up the washing solution.

4. The dishwasher of claim 3, wherein the partial program step of the dishwasher is the drying partial program step.

5. The dishwasher of claim 1, wherein the washing container has an outlet and an inlet, wherein a first pipe is configured to connect the outlet of the washing container with the sorption column, wherein a second pipe is configured to connect the inlet of the washing container from the sorption column; and wherein the fan is arranged in the first pipe to introduce a portion of one of air from the washing container and ambient air into the washing container.

6. The dishwasher of claim 5, wherein the first pipe comprises a shutoff valve and, downstream of the shutoff valve and in the direction of an air flow, an inlet valve to take in ambient air.

7. The dishwasher of claim 5, further comprising a heating element to desorb the reversibly dehydratable material and to heat up air introduced into the washing container.

8. The dishwasher of claim 7, wherein the heating element is an electric heating element.

9. The dishwasher of claim 7, wherein the heating element is arranged in the reversibly dehydratable material.

10. The dishwasher of claim 7, wherein the heating element is arranged in the first pipe.

11. The dishwasher of claim 1, further comprising a control element to select the speed of the fan one of steplessly and in a plurality of steps.

12. The dishwasher of claim 11, wherein the fan speed is regulated for controlling drying time.

13. The dishwasher of claim 2, further comprising a heat accumulator to store the thermal energy for desorption of the sorption column prior to utilizing the thermal energy to heat the at least one of the washing solution and the crockery.

14. The dishwasher of claim 13, wherein the heat accumulator is a latent accumulator.

15. The dishwasher of claim 5, wherein the dishwasher comprises a closed air system.

16. The dishwasher of claim 1, wherein air is heated by condensation heat as the air is directed through the sorption column.

17. The dishwasher of claim 16, wherein the air is additionally heated by an electrical heating element.

18. A method for treating crockery disposed in a washing container, comprising:

a. providing a dishwasher, the dishwasher comprising:

i. a washing container;

ii. a main control system programmed to conduct a plurality of partial program steps including at least a drying partial program step and a cleaning partial program step;

iii. a sorption drying device connected to the washing container in an air-conducting manner and to dry crockery therein, the sorption drying device comprising a variable speed fan and a sorption column that includes a reversibly dehydratable material; and wherein in the drying partial program step the variable speed fan is configured to conduct at least one of air from the washing container and ambient air through the sorption column with reversibly dehydratable material into the washing container, thereby removing moisture from the air during passage therethrough, and wherein in the cleaning partial program step, the variable speed fan is configured to conduct at least one of air from the washing container and ambient air through the sorption column with reversibly dehydratable material into the washing container thereby desorbing the reversibly dehydratable material and warming at least one of the washing container, washing solution, and crockery therein, and wherein the main control system is configured to control and provide different rotational speeds for the variable speed fan, wherein the main control system operates the variable speed fan at a first rotational speed during the drying partial program step, and at a different second rotational speed during the cleaning partial program step; and b. subjecting the crockery to partial program steps, comprising at least a cleaning partial program step, a rinsing partial program step, and a drying partial program step, wherein air is passed by motive force of the variable speed fan into contact with the crockery during at least one of the cleaning, rinsing, and drying partial program steps and such air is thereafter guided to the sorption drying device, wherein the sorption drying device is connected to the washing container in an air-conducting manner for passage of the air therebetween, the reversibly dehydratable material of the sorption column operates to withdraw moisture from the air during passage of the air through the sorption column, crockery retained in the dishwasher being subjected to a drying partial program step after having undergone a treatment partial program step as a result of which moisture remains on the crockery, the drying partial program step including passing air from the washing container through the sorption column, whereupon humidity is removed from the air as it is directed through the sorption column.

19. The method of claim 18, wherein thermal energy for desorption of the sorption column is utilized to heat up at least one of the washing solution and the crockery in the washing container.

20. The method of claim 18, wherein the air is directed through the sorption column by the variable speed fan, wherein the variable speed fan can be steplessly operated at a variable speed, and wherein the speed of the variable speed fan is established according to a desired duration of the drying partial program step.

21. The method of claim 18, wherein the air is directed through the sorption column by the variable speed fan, wherein the variable speed fan can be operated at a variable speed in a plurality of steps, wherein the speed of the variable speed fan is established according to a desired duration of the drying partial program step.

22. The method of claim 18, wherein the speed may be pre-selected by a user of the dishwasher using a control element of the main control system.

23. The method of claim 22, wherein the variable speed fan speed is regulated for controlling drying time.

24. The method of claim 23, wherein increasing variable speed fan speed accelerates adsorption and reduces drying time.

25. The method of claim 23, wherein decreasing variable speed fan speed reduces noise emission and increases drying time.

26. The method of claim 18, wherein air is heated by condensation heat as the air is directed through the sorption column and is additionally heated, if necessary, by an electric heating element.

27. The method of claim 18, wherein the washing items to be treated are not heated in a partial program step preceding the drying partial program step.

28. The method of claim 18, wherein the washing items to be treated are heated during a partial program step preceding the drying partial program step.

29. The method of claim 18, wherein the cleaning partial program step further comprises a prewashing step and an intermediate washing step.

30. The method of claim 18, wherein at the beginning of the cleaning partial program step washing solution is heated to a nominal temperature.

31. The method of claim 30, wherein the variable speed fan speed may be pre-selected by a user of the dishwasher to accelerate heating of the washing solution to a nominal temperature.

32. The method of claim 30, wherein an additional heating element is used to accelerate heating of the washing solution to a nominal temperature.

33. The method of claim 32, wherein the additional heating element comprises one of a water heating system and an air heating system.

34. The method of claim 18, wherein desorption of the reversibly dehydratable material occurs during the cleaning partial program step.

* * * * *